United States Patent [19]

Cox

[11] Patent Number: 4,809,525

[45] Date of Patent: Mar. 7, 1989

[54] PLUNGER LOCK WITH REMOVABLE CORE

[76] Inventor: Terry L. Cox, 3233½ Fondren, Houston, Tex. 77082

[21] Appl. No.: 198,481

[22] Filed: May 25, 1988

[51] Int. Cl.[4] ..... E05B 65/08

[52] U.S. Cl. ..... 70/100; 70/360; 70/369; 70/375

[58] Field of Search ..... 70/90, 95, 99, 100, 70/360, 361, 371, 375, 367–369

[56] References Cited

U.S. PATENT DOCUMENTS

| | | | |
|---|---|---|---|
| 1,050,692 | 1/1913 | Resch | 70/360 |
| 1,505,865 | 8/1924 | Costa | 70/360 |
| 1,832,108 | 11/1931 | Falk | 70/369 |
| 1,905,639 | 4/1933 | Jacobi | 70/369 |
| 1,951,418 | 3/1934 | Jacobi | 70/360 |
| 1,969,010 | 8/1934 | Jacobi | 70/369 |
| 1,979,938 | 11/1934 | Jacobi | 70/367 |
| 1,992,531 | 2/1935 | Kaufman | 70/90 |
| 2,098,048 | 11/1937 | Kistner | 70/360 |
| 2,268,511 | 12/1941 | Ledin . | |
| 3,187,525 | 6/1965 | Dies | 70/368 |
| 3,345,838 | 10/1967 | Russell et al. | 70/360 |
| 3,735,612 | 5/1973 | Popovici | 70/369 X |
| 3,824,817 | 7/1974 | Orr | 70/81 |
| 4,009,599 | 3/1977 | Patriquin | 70/90 |
| 4,099,395 | 7/1978 | Garza | 70/360 |
| 4,102,928 | 3/1977 | Dauenbaugh | 70/81 |
| 4,272,975 | 6/1981 | Patriquin | 70/369 |

*Primary Examiner*—Lloyd A. Gall

*Attorney, Agent, or Firm*—Daniel N. Lundeen; Bernard A. Reiter

[57] ABSTRACT

A plunger lock with a readily removable core is disclosed. The lock has a cylindrical housing and a core. The core is provided with a detent which is retractable when the proper key is inserted in the keyway of the core to permit rotation of the core within the housing. The rotation and longitudinal movement of the core within the housing is defined by the cooperation of a stop in a locking/unlocking groove formed on the core to permit the core to move longitudinally between locked and unlocked positions. The keyway opens to the surface of the core adjacent the locking/unlocking groove. A core insertion/removal groove is formed on the core adjacent the keyway on the opposite side from the locking/unlocking groove. A normal operating key which is inserted in the keyway permits retraction of the detent so that the core may be moved between the locked and unlocked positions, but prevents passage of the stop between the locking/unlocking groove and the core insertion/removal groove. When a removal key having a slot permitting passage of the stop between the locking/unlocking groove and the insertion/removal groove is employed, the core may be readily removed from the housing.

19 Claims, 3 Drawing Sheets

FIG. 1
(PRIOR ART)
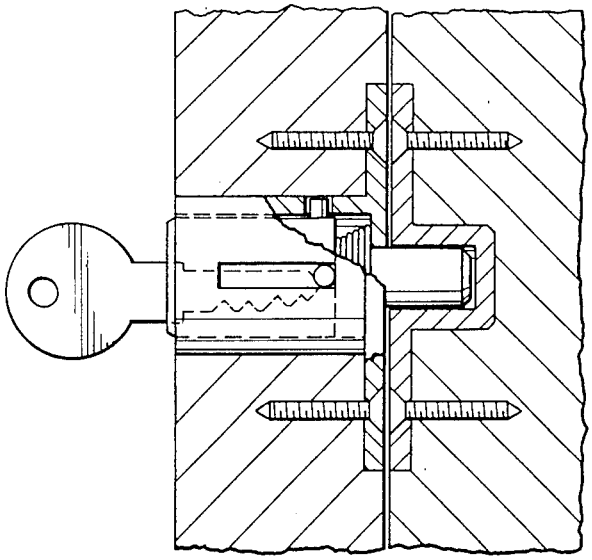
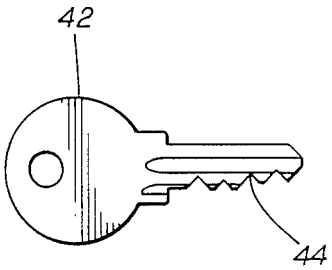
FIG. 2
(PRIOR ART)
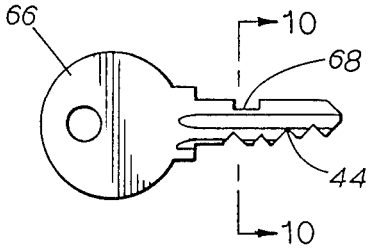
FIG. 9
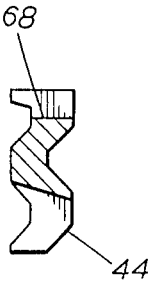
FIG. 10
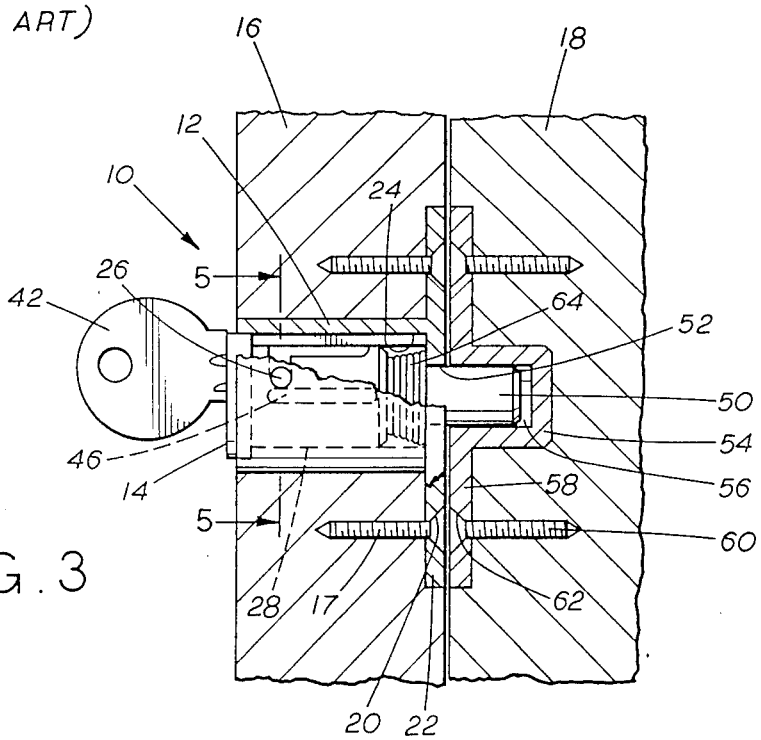
FIG. 3

PLUNGER LOCK WITH REMOVABLE CORE

BACKGROUND OF THE INVENTION

1. Field of Invention

The present invention relates to a plunger type lock having a removable core, and more particularly to such plunger type locks in which a longitudinally reciprocatable core is operable between looked and unlocked positions by a first operating key, and removable by a second removal key employing the same keyway.

2. Background of Invention

Various plunger locks are known. Such locks generally have a lock housing that retains a core which is longitudinally movable therein between an unlocked position and a locked position. Typically, the housing will be mounted in one panel and the longitudinal movement of the core in the housing will cause a bolt to project from one end of the housing into a keeper mounted in an adjacent panel which would otherwise be slidable relative to the panel in which the housing is mounted. Usually, the longitudinal reciprocation of the core within the housing is effected by the use of a proper key which is inserted into a keyway formed in the core to actuate tumbler members to release a detent to permit the relative longitudinal movement of the core with respect to the housing.

In some plunger locks, the longitudinal movement of the core within the housing is defined by a slot formed in the housing which receives a screw projecting from the core. The screw generally projects into the slot to limit rotational movement of the core within the housing, and also to limit the longitudinal movement of the core within the housing to a first locked position in which the screw is at one end of the slot, and a second unlocked position in which the screw is at the other end of the slot. A bias spring is usually used to urge the core away from the housing so that upon release of the detent by the proper key the core will be longitudinally retracted with the end of the screw in the second end of the slot defining the unlocked position.

One undesirable feature of such plunger locks heretofore used has been that it is generally difficult to rekey the lock as is sometimes desirable such as, for example, when the key to the lock has been lost, stolen or otherwise made insecure. With the plunger lock described above, it is often necessary to remove the entire housing from the panel in order to remove or change out the core with a new tumbler combination. For example, for obvious security reasons, it is generally desirable that the screw sliding in the longitudinal slot be hidden from view by the panel in which it is mounted. Thus, the screw cannot be removed to release the core without first removing the housing from the panel in which it is mounted.

Prior attempts at providing locks with removable cylinders have focused primarily on rotatable cylinder locks which are not generally longitudinally movable within a housing as is the case in a plunger type lock. Examples of non-plunger type locks with removable cylinders or cores include U.S. Pat. Nos. 3,824,817 to Orr; 4,012,928 to Dauenbaugh; 4,272,975 to Patriquin; and 2,268,511 to Ledin. The cylinder or core removal mechanisms described in these references are not generally adaptable to plunger type locks since the mechanism would not be longitudinally movable in a housing without rendering the core or cylinder removal mechanism inoperable. Moreover, some of these locks, such as those described in Orr and Dauenbaugh, would still require access to the back of the panel on which the lock is mounted, and hence would be unsuitable for use in conjunction with sliding panels in which there is no or only limited access to the rear of the panel on which the lock is mounted.

One attempt at providing a plunger lock is described in U.S. Pat. No. 4,009,599 to Patriquin. In this reference, the outwardly projecting screw of the cylinder is replaced with a stud integral therewith which is slidable in a longitudinal slot formed in the housing. This lock is also provided with a locking wafer projected or retracted from the periphery of the cylinder by the use of a proper key inserted into a keyway formed in the cylinder. The locking wafer, when projected from the cylinder, extends into a rotational restraining groove longitudinally formed on the inside face of the housing, or into a locking slot formed at the end of the restraining groove. The lock is further provided with a connecting slot which extends transversely from the longitudinal slot to a longitudinal removal groove formed in the inside face of the housing. When the proper key is used, the lock can be selectively operated between the locked and unlocked positions, or in a somewhat more difficult procedure, removed by aligning the stud with the connecting groove and rotating the cylinder so that the stud aligns with the removal groove and sliding the cylinder longitudinally outward therefrom. However, the same key which operates the lock can also effect removal. This is disadvantageous in some situations where it is not desirable for the operator of the lock to be able to remove the cylinder from the housing. Moreover, since the connecting slot is generally concealed by the panel in which the lock is mounted, it can be difficult to align the stud on the cylinder therewith. In addition, it can be difficult to retract the locking wafer from the rotational restraining groove and rotate the cylinder at the same time.

Other references which may be relevant include U.S. Pat. Nos. 1,050,692; 1,505,865; 1,951,418; 2,098,048; 3,345,838; and 4,099,395.

Accordingly, there is a need for a plunger type lock with a removable cylinder or core in which the cylinder or core is readily removable by a removal key without access to the rear of the panel on which the lock is mounted, and yet which is operable by an operating key which cannot be used to remove the cylinder or core from the housing.

SUMMARY OF THE INVENTION

The present invention provides a plunger lock which is operable when used with an operating key, and in which a core within a housing of the lock is removable therefrom by the use of a separate removal key which uses the same keyway as the operating key. In accordance with the present invention, the lock includes a cylindrical housing and a core. The housing has a longitudinal wall and a stop disposed thereon. The core has a longitudinal surface for presentation to the wall of the housing. A locking/unlocking groove is formed in the surface of the core for receiving the stop. This groove defines rotational and longitudinal movement of the housing with respect to the core therewithin between locked and unlocked positions. A core insertion/removal groove is formed in the surface of the core and is also adapted for receiving the stop. The insertion/removal groove has an open end to allow insertion of the core into the housing and removal therefrom. A keyway is formed in the core. The keyway opens to the surface of the core between the locking/unlocking groove and the core insertion/removal groove to prevent passage of the stop from one groove to the other when an operating key is placed in the keyway. However, when a core removal/insertion key is used which has a recess formed in an outer edge adjacent to the grooves, the stop is permitted to pass between the locking/unlocking groove and the removal/insertion groove, thereby permitting assembly and disassembly of the core with the housing. A detent projects from the surface of the core and is responsive to the insertion of the operating and removal/insertion keys in the keyway to be retractable. A detent recess corresponding thereto is formed in the wall of the housing for receiving the detent when the housing and the core are in the locked position.

The keyway is preferably accessible in one end of the core with a bolt projecting from the opposite end thereof. The housing desirably has an end wall apertured to receive the bolt extending therethrough. The detent may be longitudinally disposed and receivable in the recess comprised of a similarly longitudinally oriented groove. The looking/unlocking groove preferably has a longitudinal portion adjacent the keyway and a portion extending transversely therefrom. The core is preferably longitudinally biased in the housing, especially by a spring positioned between the core and the end wall of the housing.

In one embodiment, the operating key cannot be removed from the keyway when the housing and the core are in the unlocked position, for example, by depressing the detent against the wall of the housing in the relative unlocked position. In an alternate embodiment, the operating key is removable from the keyway when the housing and core are in the relatively unlocked position, for example, by providing a second detent recess for receiving the detent when the housing and the core are in the relative unlocked position. If desired, the housing may be provided with mounting lugs or flanges for securedly positioning the housing in a sliding panel, for example.

In a further aspect of the invention, there is provided a lock including a cylindrical housing and a core adapted to be received therein. The cylindrical housing has an open end, an apertured end, a wall extending longitudinally between the ends, stop means disposed on the wall and a recess formed in the wall. The core is longitudinally and rotatably slidable in the housing. The core has a longitudinal keyway opening at an anterior end of the core and to a longitudinal surface thereof. The keyway is adapted to receive a key to cooperate with a pin and tumbler mechanism to release a detent received in the recess of the housing so that the detent becomes biased outwardly from the core. The detent cooperates with the recess in the absence of the key in the keyway to restrict rotation of the core within the housing. First and second grooves are formed on the core adjacent the keyway on opposite sides thereof. The first groove cooperates with the stop means to define longitudinal and rotational movement of the core within the housing between relative locked and unlocked positions. In the locked position, a posterior end of the core is proximal the apertured end of the housing to project through the aperture a bolt extending longitudinally from the posterior end of the core. In the unlocked position, the posterior end of the core is spaced away from the apertured end of the housing so that the bolt is retracted in the aperture. The second groove opens adjacent the posterior end of the core to cooperate with the stop means for removal of the core from, and insertion of the core into the housing. The stop means are retained in the first groove by an operating key disposed in the keyway. The stop means is transferable between the first and second grooves by a removal key disposed in the keyway.

In another aspect, the invention provides a replacement cylinder and key combination for a plunger lock with a housing having an apertured end wall and a longitudinal wall with a detent recess formed therein and a stop means fixedly attached thereto. The cylinder/key combination includes a cylindrical body and operating and replacement keys provided therewith. The cylindrical body has anterior and posterior ends and a cylindrical surface extending longitudinally therebetween. A longitudinal keyway is formed in the body opening to the anterior end and along the longitudinal surface. A detent releasably projects from the surface. Tumbler means are operatively associated with the keyway for releasing the detent so that the detent is retractable into shear with the surface. A first groove is formed on the surface extending from the posterior end to adjacent the keyway. A second groove is formed on the surface extending longitudinally from a position spaced from the posterior end adjacent the keyway opposite the first groove to a transversely extending portion of the second groove spaced from the anterior end of the body. Both the operating key and the replacement key have an interior edge for activating the tumbler mechanism to release the detent. The operating key has a continuous outer edge for separating the first and second grooves when it is placed in the keyway. The replacement key has an outer edge with a transverse slot for joining the first groove with the second groove. The cylinder may further include a bolt longitudinally projecting from the posterior end of the body, and a spring secured concentrically about the bolt. Preferably, the grooves in the surface of the body and the slot in the replacement key are adapted to receive the stop means of the lock housing to define movement of the cylinder within the housing, for example, between locked and unlocked positions. The detent is preferably adapted to be received in the housing recess to selectively rotatably lock and release the cylinder within the housing. The bolt is preferably adapted to project through the housing aperture in a locked position, and to be retracted therein in an unlocked position.

BRIEF DESCRIPTION OF THE DRAWINGS

FIG. 1 is a side sectional view of a conventional plunger lock according to the prior art;

FIG. 2 is a side elevation of a key used to operate the lock of FIG. 1;

FIG. 3 is a side sectional view of a lock according to the present invention installed in a panel which slides relative to an adjacent panel and shown in the locked position;

FIG. 9 is a side perspective view of a removal/insertion key for use in the lock of FIG. 3;

FIG. 10 is a cross sectional view of the key of FIG. 9 as seen along the lines 10—10;

DETAILED DESCRIPTION OF THE PREFERRED EMBODIMENTS

Figure 4:
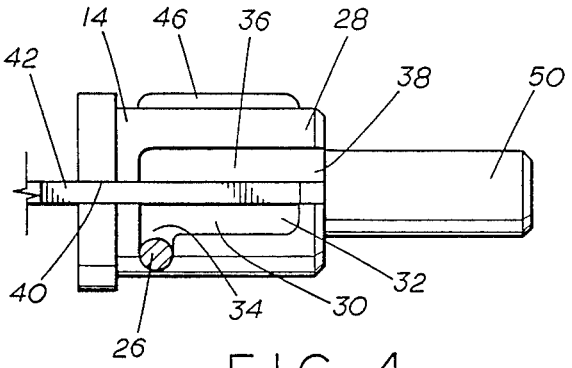
FIG. 4 is a perspective view of the core employed in the lock of FIG. 3.
Figure 5:
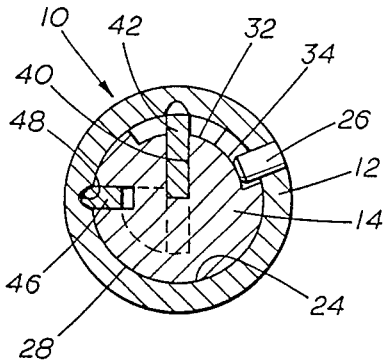
FIG. 5 is a cross-sectional view of the lock of FIG. 3 as viewed along the lines 5—5.

Referring now to FIGS. 3–5 in which like parts are indicated by like reference numerals, a lock 10 according to one embodiment of the present invention includes a housing 12 and a core 14. The housing 12 is mounted in a panel 16 by mans of screws 17 extending through perforations 20 in mounting lugs or flanges 22 extending radially from housing 12. Panel 16 is slidable with respect to a panel 18, such as, for example, that used in merchandise showcases, in sliding doors, etc.

The housing 12 has a wall 24. A roll pin 26 or other suitable stop means is fixedly attached to or formed integral with the wall 24, and projects inwardly therefrom. The core 14 has an exterior longitudinal surface 28 which is presented to the wall 24. A locking/unlocking groove 30 is formed in the surface 28. The groove 30 has a longitudinal portion 32 and a portion 34 extending transversely therefrom, as best seen in FIGS. 4 and 5. A second core insertion/removal groove 36 is formed in the surface 28 and has an open end 38.

A keyway 40 is formed longitudinally in the core 14. The keyway 40 opens to the surface 28 of the core 14 and receives an operating key 42. The operating key 42 is essentially a conventional key as seen in FIG. 2. The key 42 is provided with a series of serrations 44 corresponding to a series of pins or tumblers (not shown) positioned in the core 14 adjacent the keyway 40. When the proper key 42 is employed by insertion in the keyway 40, the pins or tumblers are actuated by the serrations 44 to rotatably release the core 14 within the housing 12. A detent 46 projects from the surface 28 of the core 14 for this purpose. The detent is responsive, for example, through a conventional pin and tumbler mechanism (not shown), to the insertion of the key 42 into the keyway 40 to be retractable, for example, against a conventional spring bias (not shown). There is a corresponding recess 48 formed in the wall 24 of the housing 12 for receiving the detent 46 with the core 14 rotatably positioned in the locked position.

A bolt 50 extends longitudinally from the core 14 generally at an opposite end thereof from the opening of the keyway 40. In the looked position as illustrated in FIG. 3, the bolt 50 is projected through aperture 52 formed in an end of housing 12. In a typical application, the bolt 50 in the locked position is received by a keeper 54 mounted in opposing panel 18 in a conventional manner. For example, the keeper 54 may include recess 56 which receives the bolt 50 in longitudinal alignment with the perforation 52, flanges 58 extending transversely therefrom and secured in the panel 18 by means of screws 60 extending across perforations 62 formed therein. The projection of the bolt 50 into the recess 56 generally prevents sliding movement of the panel 16 with respect to the panel 18, i.e. it locks the sliding doors or showcase assembly with which the lock 10 is employed. The lock 10 is further preferably provided with a spring 64 or other bias means positioned at the posterior of the core 14 around the bolt 50 between the core 14 and apertured end of housing 12.

In the locked position as best illustrated in FIGS. 3–5, the roll pin 26 is received in transverse portion 34 of locking/unlocking groove 30 so that longitudinal movement of the core 14 within the housing 12 is prevented. The core 14 cannot be rotated in the housing 12 to permit the stop 26 to slide in the longitudinal portion 32 of the locking/unlocking groove 30 since the detent 46 is projected into the recess 48. The bolt 50 projects into the keeper 54 and thus locks the panels 16, 18 in relative position with respect to each other.

To unlock the lock 10, the proper key 42 is inserted in the keyway 40 to permit retraction of the detent 46 against the spring bias thereof. Since the detent 46 is now retractable into the longitudinal surface 28 of the core 14, the core 14 can be rotated with respect to the housing 12 into the unlocked position illustrated in FIGS. 6–8. In moving from the locked position illustrated in FIGS. 3–5 to the unlocked position illustrated in FIGS. 6–8, the rotation of the core 14 within the housing 12 causes the detent 46 to be depressed into the core 14 at shear with the longitudinal surface 28. Simultaneously, the roll pin 26 moves in the locking/unlocking groove 30 from the transverse portion 34 into the longitudinal portion 32. The spring 64 forces the core 14 longitudinally outwardly from the housing 12 to retract the bolt 50 from the keeper 54 through the housing aperture 52, thus permitting sliding movement between the panels 16, 18. In this unlocked position, further rotation of the core 14 within the housing 12 is prevented by the positioning of the stop 26 between the radially outwardly extending edge of the longitudinal portion 32 of the groove 30 on one side, and the radially outwardly extending edge of the key 42 in the keyway 40 on the other side of the stop 26. In this embodiment, the key 42 is preferably not removable from the keyway 40, for example, the depression of the detent 46 being depressed by the wall 24 of the housing 12, thereby preventing movement of the pins and tumblers necessary to permit such removal of the key 42.

Figure 6:
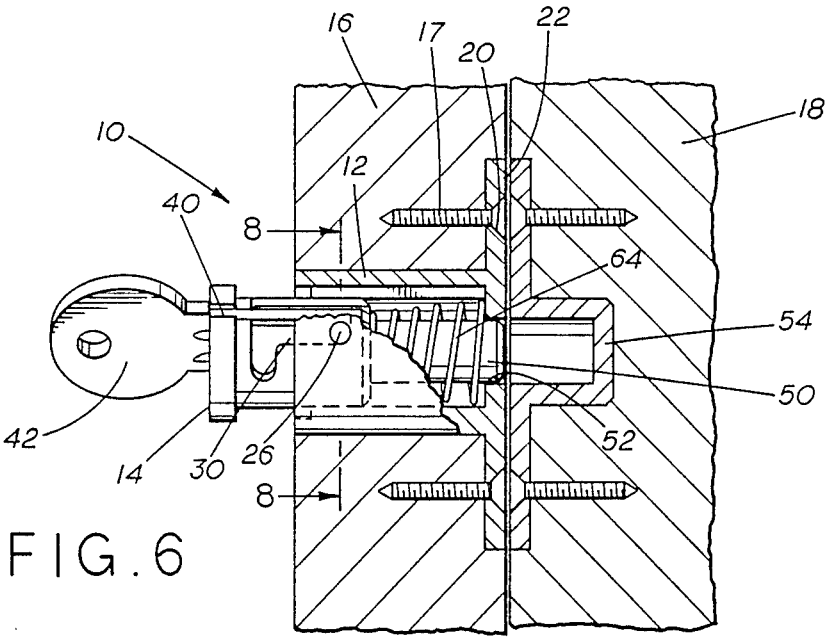
FIG. 6 is a side sectional view of the lock of FIG. 3 shown in the unlocked position.
Figure 7:
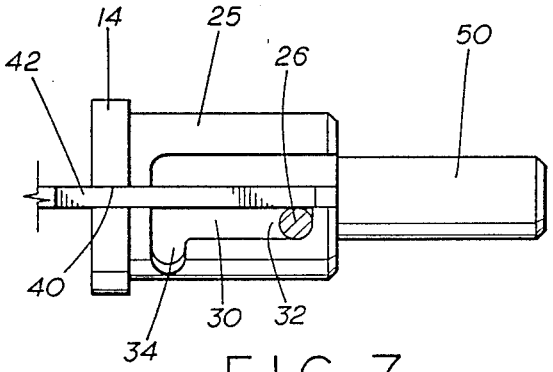
FIG. 7 is a perspective view of the core of the lock of FIG. 6.
Figure 8:
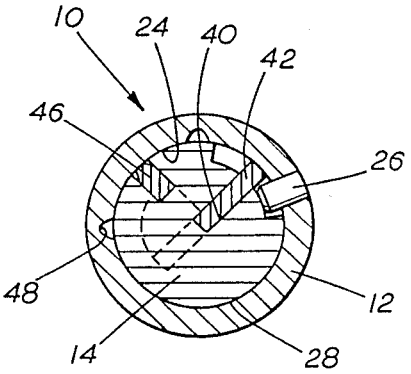
FIG. 8 is a cross sectional view of the lock of FIG. 6 as seen along the lines 8—8.

To return the unlocked look 10 illustrated in FIGS. 6–8 to the locked position illustrated in FIGS. 3–5, the unlocking procedure just described is reversed. The core 14 is pushed longitudinally inwardly into the housing 12 against the bias of the spring 64. When the stop 26 is aligned with the transverse portion 34 of locking/unlocking groove 30, the core 14 is rotated so that the stop 26 is received in the transverse groove portion 34 to secure the core 14 in the longitudinally locked position illustrated in FIGS. 3–5. The rotation into the locked position also serves to align the detent 46 with the recess 48 so that the detent 46 projects therein from the core 14 to permit withdrawal of the key 42 from the pins and tumblers and the keyway 40. Without the insertion of the key 42, the projection of the detent 46 into the recess 48 prevents rotation of the core 14 within the housing 12 and the stop 26 cooperates with the locking/unlocking groove 30 to prevent longitudinal movement of the core 14 within the housing 12.

Figure 11:
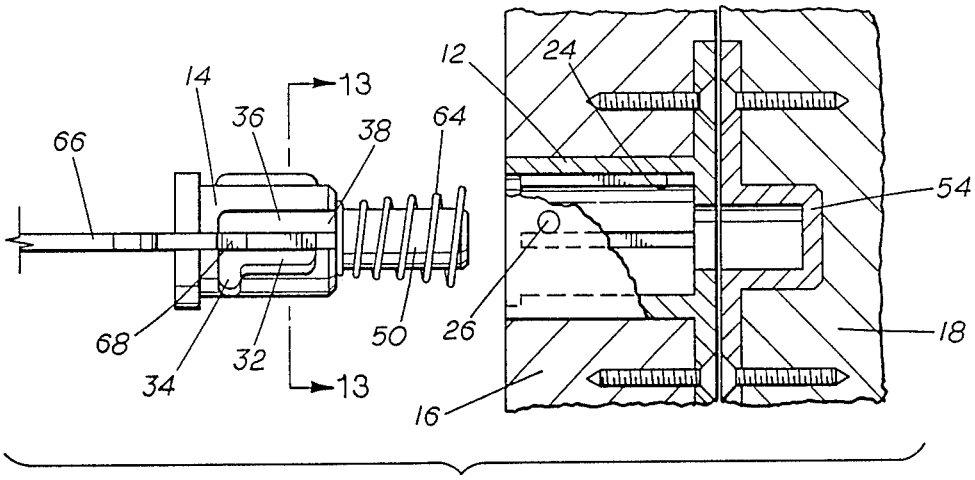
FIG. 11 is a side sectional view of the lock of FIG. 3 in the disassembled position.
Figure 12:
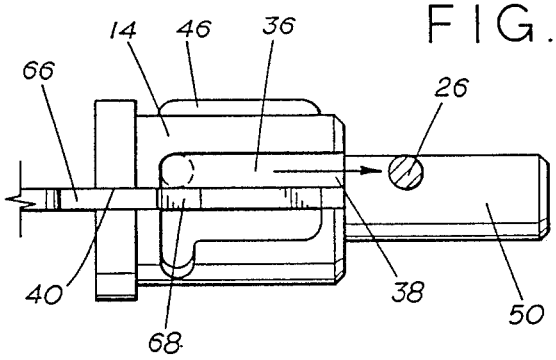
FIG. 12 is a perspective view of the core of the lock of FIG. 11.
Figure 13:
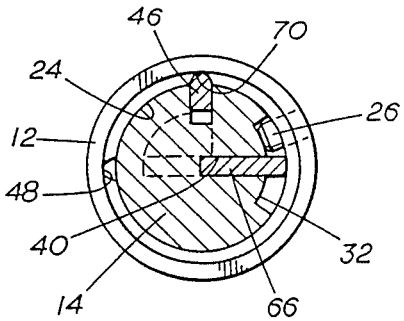
FIG. 13 is a cross sectional view of the lock of FIG. 11 as viewed along the lines 13—13.

When it is desired to remove the core 14 from the housing 12, a removal key 66 as illustrated in FIG. 9 is employed. The key 66 is provided with the same serrations 44 on one side thereof as the operating key 42, but in addition includes a transverse slot or depression 68 in the opposite side to accommodate passage of the stop 26 therethrough when the key 66 is inserted in the keyway 40. Preferably, the depth of the recess 68 corresponds to that of the grooves 30, 36. When the key 66 is inserted in the keyway 40, the serrations 44 cooperate with the pin and tumbler mechanism to render the detent 46 retractable in the same manner as described hereinabove as for the operating key 42 in cooperation therewith. This permits the core 14 to be rotated so that the stop 26 travels from the transverse groove portion 34 through the recess 68 into the core removal/insertion groove 36. Since the end 38 of the removal groove 36 opens to the posterior end of the core 14, the core 14 may be removed from the housing 12 as illustrated in FIGS. 11–13. Replacement of the core 14 in the housing 12 is accomplished by reversing this procedure. Thus, the core is readily replaceable by one with the proper removal/insertion key 66 having the proper combination of serrations 44 and recess 68. If desired, another recess 70 which is similar to that of the recess 48 may also be formed in the wall 24 of the housing 12 to receive the detent 46 when the stop 26 is aligned in the insertion/removal groove 36.

Figure 14:
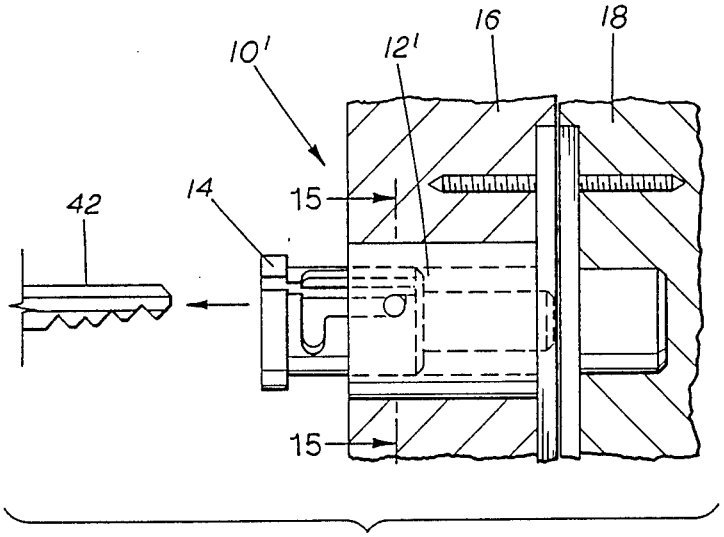
FIG. 14 is a side sectional view of a lock according to the present invention in which the key is removable therefrom in the unlocked position.
Figure 15:
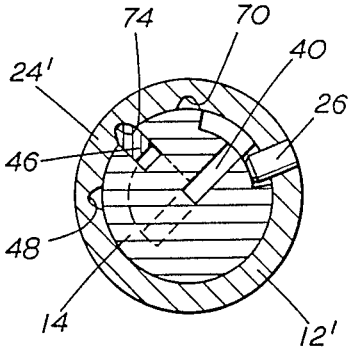
FIG. 15 is a cross sectional view of the lock of FIG. 14 as viewed along the lines 15—15.

In an alternate embodiment illustrated in FIGS. 14 and 15, the lock 10' is the same as the lock 10 illustrated in FIGS. 3–13, except that it is designed so that the key 42 may be removed from the core 14 when the lock 10' is in the unlocked position. In this embodiment, an additional recess 74 is formed in the wall 24' in the housing 12' to receive the detent 46 and to allow the detent 46 to project from the core 14 when the core 14 is rotated into the unlocked position as illustrated in FIG. 15. Thus, the pin and tumbler combination does not prevent the key 42 from being withdrawn from the keyway 40 when the core 14 is rotated into the unlocked position. Likewise, the lock 10' cannot be locked without reinsertion of the key 42 in the keyway 40 since the detent 46 is not otherwise retractable, thus preventing rotation of the core 14 to move the roll pin 26 into the transverse groove portion 34 or the removal groove 36.

In a preferred embodiment, the core 14 is manufactured by modification of a cylinder lock obtained under the trade designation Medeco, Model 72S, by machining the grooves 30, 38 thereon. The Medeco cylinder lock is preferred since the key serrations 44 and the respective pin and tumbler mechanism are transversely angled to further inhibit picking of the lock.

The lock of the present invention has several desirable features. It is normally operable as a conventional plunger lock when used with the operating key. However, when used with the removal key, the core can be readily replaced or changed out as desired. For example, operating personnel may be assigned or given access to the operating key and may thus operate the lock as needed. However, the distribution of the removal key may be limited, for example, to supervisory or managerial personnel. Then, when it is desired to change out the locks in a particular location because of the loss, theft or unauthorized duplication of the operating key, the core and the lock can be readily replaced with a different combination to maintain the security thereof. In addition, the housing 12 may permissibly be exposed since it is not possible to remove the core 14 by removing any threaded screw as would otherwise be possible in the conventional locks as illustrated in FIG. 1. Thus, it is not necessary that the housing 12 have the same longitudinal dimension as the panel 16 in which it is mounted. Further, removal of the core 14 from the housing 12 is preferably facilitated by alignment of the recess 68 in the key 66 with transversely opposed ends of the grooves 30, 36 when the core 14 is held longitudinally in the locked position by urging the core 14 inwardly against the bias spring 64. Thus, the recess 68 and the stop means 26 may be made self-aligning, and it is not necessary to know the exact location of the stop and a connecting slot.

The foregoing is illustrative and explanatory of the invention. Many changes in the materials, size, shape and configuration of the various elements and components will become apparent to those skilled in the art. It is intended that all such variations which fall within the scope and spirit of the appended claims be embraced thereby.

What is claimed is:

1. A lock comprising:

a cylindrical housing having a longitudinal wall and a stop disposed thereon;

a core having a longitudinal surface for presentation to said wall;

a locking and unlocking groove formed in said surface for receiving said stop and defining rotational and longitudinal movement of said housing with respect to said core therewithin between locked and unlocked positions;

a core insertion and removal groove formed in said surface for receiving said stop, said insertion and removal groove having an open end to allow insertion of said core into said housing and removal therefrom;

a keyway formed in said core and opening to said surface between said grooves to prevent passage of said stop therebetween when a proper operating key is inserted in said keyway, and to allow said passage when a proper core removal and insertion key having a recess formed on an outer edge adjacent said grooves to accommodate movement of said stop therethrough is used, said operating key lacking said recess;

a detent projecting from said surface and responsive to said insertion of said key in said keyway to be retractable; and a first detent recess formed in said wall for receiving said detent when said housing and core are in said locked position.

2. The lock of claim 1, wherein said detent is longitudinal and said housing recess comprises a longitudinal groove.

3. The lock of claim 1, wherein said lock and unlocking groove has a longitudinal adjacent said keyway and portion extending transversely therefrom.

4. The lock of claim 1, wherein said keyway is accessible at one end of said core and a bolt projects from an opposite end thereof.

5. The lock of claim 4, wherein said housing has an end wall apertured to receive said bolt extending therethrough.

6. The lock of claim 5, wherein said core is longitudinally biased by a spring positioned between said core and said end wall.

7. The lock of claim 1, wherein said core is longitudinally biased in said housing.

8. The lock of claim 1, wherein said operating key cannot be removed from said keyway when said housing and core are in said unlocked position.

9. The lock of claim 8, wherein said detent is depressed by said wall in the relative unlocked position.

10. The lock of claim 1, wherein said operating key is removable from said keyway when said housing and core are in said unlocked position.

11. The lock of claim 10, wherein said wall has a second detent recess for receiving said detent when said housing and core are in the relative unlocked position.

12. The lock of claim 1, wherein said housing is provided with mounting lugs.

13. A lock comprising:

a cylindrical housing having an open end, an apertured end, a wall extending longitudinally between said ends, stop means disposed on said wall, and a recess formed in said wall;

a core adapted to be received in said open end of said housing and longitudinally and rotatably slidable therein, said core having a longitudinal keyway opening at an anterior end of said core, and to a longitudinal surface thereof, and adapted to receive a key to cooperate with a pin and tumbler mechanism to release a detent biasedly received in said housing recess, said detent cooperating with said recess in the absence of said key in said keyway to restrict rotation of said core within said housing;

first and second grooves formed on said core adjacent said keyway on opposite sides thereof, said first groove cooperating with said stop means to define longitudinal and rotational movement of said core within said housing between a locked position, wherein a posterior end of said core is proximal said apertured end of said housing to project therethrough a bolt extending longitudinally from said posterior end, and an unlocked position, wherein said posterior end of said core is spaced away from said apertured end of said housing so that said bolt is retracted in said aperture;

said second groove opening adjacent said posterior end of said core to cooperate with said stop means for removal of said core from, and insertion into said housing, said stop means being retained in said first groove by an operating key disposed in said keyway and transferable between said first and second grooves by a removal key disposed in said keyway.

14. A removable cylinder and key combination adapted for use in a plunger lock housing having an apertured end wall and a longitudinal wall with a detent recess formed therein and a stop means fixedly attached thereto, comprising:

a cylindrical body having anterior and posterior ends and a cylindrical surface extending longitudinally therebetween:

a longitudinal keyway formed in said body opening to said anterior end and along said surface;

a detent releasably projecting from said surface;

tumbler means operatively associated with said keyway for releasing said detent so that said detent is retractable into shear with said surface;

a first groove formed in said surface from said posterior end to adjacent said keyway;

a second groove formed on said surface extending longitudinally from a position spaced from said posterior end adjacent said keyway opposite said first groove to a transversely extending portion of said second groove spaced from said anterior end;

an operating key provided with said body having an interior edge for activating said tumbler mechanism to release said detent and a continuous outer edge for separating said first and second grooves; and a core replacement key provided with said body having an interior edge for activating said tumbler mechanism to release said detent and an outer edge with a transverse slot for joining said first groove with said second groove.

15. The cylinder and key combination of claim 14, further comprising:

a bolt longitudinally projecting from said posterior end of said body.

16. The cylinder and key combination of claim 15, further comprising:

a concentric spring secured to said bolt.

17. The cylinder and key combination of claim 16, wherein said grooves and said slot are adapted to receive the stop means of the lock housing to define movement of the cylindrical body within the housing.

18. The cylinder and key combination of claim 17, wherein said detent is adapted to be received in the housing recess to selectively rotatably lock and release the cylindrical body within the housing.

19. The cylinder and key combination of claim 18, wherein said bolt is adapted to project through the housing aperture in a locked position and to be retracted therein in an unlocked position.

* * * * *

UNITED STATES PATENT AND TRADEMARK OFFICE

CERTIFICATE OF CORRECTION

PATENT NO. : 4,809,525

DATED : March 7, 1989

INVENTOR(S) : Terry L. Cox

It is certified that error appears in the above-identified patent and that said Letters Patent is hereby corrected as shown below:

In claim 3, column 8, lines 56-57, insert the word -- portion -- between "longitudinal" and "adjacent".

Signed and Sealed this

Twenty-second Day of August, 1989

*Attest:*

*Attesting Officer*

DONALD J. QUIGG

*Commissioner of Patents and Trademarks*